US010553922B2

(12) United States Patent
So et al.

(10) Patent No.: US 10,553,922 B2
(45) Date of Patent: Feb. 4, 2020

(54) MULTI-LINE PHASE SHIFTER OF MULTI-BAND MOBILE COMMUNICATION BASE STATION ANTENNA

(71) Applicant: KMW INC., Hwaseong-si (KR)

(72) Inventors: Sung-Hwan So, Hwaseong-si (KR); Hun-Jung Jung, Hwaseong-si (KR); Kwang-Seok Choi, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 130 days.

(21) Appl. No.: 15/842,923

(22) Filed: Dec. 15, 2017

(65) Prior Publication Data

US 2018/0108962 A1 Apr. 19, 2018

Related U.S. Application Data

(63) Continuation of application No. PCT/KR2016/002619, filed on Mar. 16, 2016.

(30) Foreign Application Priority Data

Jun. 15, 2015 (KR) ..... 10-2015-0084066

(51) Int. Cl.
*H01P 1/18* (2006.01)
*H01P 5/12* (2006.01)
(Continued)

(52) U.S. Cl.
CPC ..... *H01P 1/18* (2013.01); *H01P 1/184* (2013.01); *H01P 1/2135* (2013.01); *H01P 5/12* (2013.01);
(Continued)

(58) Field of Classification Search
CPC ..... H01Q 21/0075; H01Q 3/26; H01Q 1/246; H01Q 3/32; H01P 1/182; H01P 1/183;
(Continued)

(56) References Cited

U.S. PATENT DOCUMENTS 4,198,641 A * 4/1980 Gibson ..... H01Q 21/24 342/361
2012/0056692 A1* 3/2012 Moon ..... H01P 1/184 333/136

FOREIGN PATENT DOCUMENTS

KR 10-2006-0079056 A 7/2006
KR 10-2010-0122005 A 11/2010
(Continued)

OTHER PUBLICATIONS

International Search Report for PCT/KR2016/002619, dated Sep. 30, 2016, and its English translation.
(Continued)

*Primary Examiner* — Robert J Pascal
*Assistant Examiner* — Jorge L Salazar, Jr.

(57) ABSTRACT

A multi-line phase shifter of a multi-band mobile communication base station antenna includes: a multi-line phase shifting circuit for receiving an input signal of a first frequency band, and dividing and phase-shifting the input signal so as to correspond to a plurality of radiation elements; and a plurality of frequency combination/division circuits for receiving a plurality of signals divided and phase-shifted by the multi-line phase shifting circuit and a plurality of signals of a second frequency band which have been inputted by being divided and phase-shifted for a plurality of radiation elements by an external multi-line phase shifter, combining corresponding signals, and outputting the same to the plurality of radiation elements.

12 Claims, 3 Drawing Sheets

(51) Int. Cl.

| | |
|---|---|
| ***H01Q 3/26*** | (2006.01) |
| ***H01Q 1/24*** | (2006.01) |
| ***H01Q 3/32*** | (2006.01) |
| ***H01P 1/213*** | (2006.01) |

(52) U.S. Cl.
CPC ..... *H01Q 1/246* (2013.01); *H01Q 3/26* (2013.01); *H01Q 3/32* (2013.01)

(58) Field of Classification Search
CPC .... H01P 5/12; H01P 1/18; H01P 1/184; H01P 1/2135
USPC ..... 333/125, 126, 128, 134, 135, 136, 137, 333/156–161; 343/853
See application file for complete search history.

(56) References Cited

FOREIGN PATENT DOCUMENTS

| | | | |
|---|---|---|---|
| KR | 10-2011-0057658 | A | 6/2011 |
| KR | 10-1415540 | B1 | 7/2014 |
| KR | 10-2015-0053487 | A | 5/2015 |

OTHER PUBLICATIONS

Written Opinion for PCT/KR2016/002619, dated Sep. 30, 2016, and its English translation.

* cited by examiner

MULTI-LINE PHASE SHIFTER OF MULTI-BAND MOBILE COMMUNICATION BASE STATION ANTENNA

CROSS-REFERENCE TO RELATED APPLICATION

This application is a Continuation of International Application No. PCT/KR2016/002619, filed on Mar. 16, 2016, which claims the benefit of and priority to Korean Patent Application No. 10-2015-0084066, filed on Jun. 15, 2015, the content of which are herein incorporated by reference in their entirety.

TECHNICAL FIELD

The present invention relates to an antenna that can be applied to a base station or a relay station in a network of mobile communications, such as PCS, cellular, CDMA, GSM, and LTE, and more particularly, to a multi-line phase shifter (MLPS) used to adjust vertical beam tilt of multi-band in a multi-band antenna device.

BACKGROUND ART

In the current mobile communication environment, second generation (2G), 3G, and 4G long term evolution (LTE) have been commercialized, and introduction of the next-generation 5G system has been considered. In accordance with communication systems, communication service providers, and nations, various mobile communication service frequency bands coexist, and base station environments have also been diversified. Accordingly, in order to implement an efficient base station system and to save the base station operation cost, broadband and multi-band systems that can cover various service bands have been constructed in a base station (and base station antenna).

FIG. 1 is a schematic block diagram illustrating an example of the configuration of a general multi-band mobile communication base station antenna. Referring to FIG. 1, a multi-band mobile communication base station antenna 10 has a multi-band antenna structure capable of servicing a first frequency band Band1 and a second frequency band Band2. The first frequency band may be, for example, a US-personal communication service (US-PCS) band of 1.9 GHz (e.g., 1.850 to 1.995 GHz), and the second frequency band may be, for example, a broadband radio service (BRS) band of 2.5 GHz (e.g., 2.495 to 2.690 GHz).

In the base station antenna 10, although separate radiation elements for respective frequency bands may be provided, for miniaturization of the corresponding base station antenna 10, a plurality of radiation elements of common first and second frequency bands, for example, first to fifth radiation elements 111, 112, 113, 114, and 115, may be configured to be vertically arranged in a line. The first to fifth radiation elements 111 to 115 are broadband radiation elements having the broadband characteristics, and are provided to cover a band having about 45% fractional bandwidth. The radiation elements may have, for example, the operation characteristic of 1710 to 2690 MHz.

In such a structure, in order to provide an electrically vertical tilt with respect to the overall radiated beams of the first frequency band, an input signal In1 of the first frequency band is dividedly output to the first to fifth radiation elements 111 to 115, and phases of respective divided signals through the first to fifth radiation elements 111 to 115 are shifted by a first multi-line phase shifter 121 so that the divided signals have predetermined phase differences between them. In the same manner, in order to provide an electrically vertical tilt with respect to the overall radiated beams of the second frequency band, an input signal In2 of the second frequency band is dividedly output to the first to fifth radiation elements 111 to 115, and phases of respective divided signals through the first to fifth radiation elements 111 to 115 are shifted by a second multi-line phase shifter 122 so that the divided signals have predetermined phase differences between them. An example of such first and second multi-line phase shifters 121 and 122 is disclosed in the applicant's prior application, Korean Patent Application No. 2009-40978 (title: Multi-line phase shifter for vertical beam tilt control antenna, application date: May 11, 2009, Inventors: Young-chan Moon, O-suk Choi, In-ho Kim, and kwang-suk Choi).

On the other hand, the plurality of divided signals through the first to fifth radiation elements 111 to 115 of the first multi-line phase shifter 121 and the plurality of divided signals through the first to fifth radiation elements 111 to 115 of the second multi-line phase shifter 122 are correspondingly combined through first to fifth frequency combiners/dividers 131, 132, 133, 134, and 135 to be provided to the corresponding radiation elements. In this case, transferring of the plurality of signals between the first and second multi-line phase shifters 121 and 122 and the first to fifth frequency combiners/dividers 131 to 135 is performed through a feeding cable of a predetermined standard, such as a coaxial cable. Each of the first to fifth frequency combiners/dividers 131 to 135 may have a diplexer or duplexer structure in which a filter portion for filtering the first frequency band and a filter portion for filtering the second frequency band are combined.

As illustrated in FIG. 1, in a multi-band base station antenna, the respective bands have different electrical beam tilting conditions, and separate multi-line phase shifters are required to perform beam tilting for the respective bands. In this case, since a relatively large number of feeding cables should be installed for connection between the respective multi-line phase shifters and the plurality of frequency combiners/dividers, the multi-band base station antenna has the problem that the internal structure of the multi-band base station antenna becomes complicated or the overall size is increased.

In order to solve this problem, various schemes for optimizing the installation locations or connection structures of the plurality of multi-line phase shifters and the plurality of frequency combiners/dividers in the multi-band base station antenna have been considered, but their effects are relatively insignificant.

INVENTION

Technical Problem

One aspect of the present invention is to provide a multi-line phase shifter capable of reducing the number of feeding cables required in a multi-band mobile communication base station antenna.

Another aspect of the present invention is to provide a multi-line phase shifter of a multi-band mobile communication base station antenna capable of having a more optimized structure.

Technical Solution

In one aspect of the present invention, a multi-line phase shifter of a multi-band mobile communication base station antenna includes: a multi-line phase shifting circuit configured to receive an input signal of a first frequency band and to divide and phase-shift the received signal so as to correspond to a plurality of radiation elements; and a plurality of frequency combination/division circuits configured to receive a plurality of signals divided and phase-shifted by the multi-line phase shifting circuit and a plurality of signals of a second frequency band divided and phase-shifted for the plurality of radiation elements and input by an external multi-line phase shifter, to combine the corresponding signals, and to output the combined signals to the plurality of radiation elements.

Each of the plurality of frequency combination/division circuits may have a diplexer or duplexer circuit structure in which a filter portion configured to filter the first frequency band and a filter portion configured to filter the second frequency band are structurally combined.

The multi-line phase shifting circuit may include a circuit pattern formed on a PCB type main board to phase-shift and divide a signal input to an input port that receives the input signal of the first frequency band to a plurality of output points; each of the plurality of frequency combination/division circuits may be implemented by a PCB type diplexer or duplexer circuit pattern on the main board; and in each of the plurality of frequency combination/division circuits, a first input terminal of the diplexer or duplexer circuit pattern may be connected to a corresponding one of the plurality of output points of the multi-line phase shifting circuit, a second input terminal of the diplexer or duplexer circuit pattern may receive a corresponding one of the plurality of signals of the second frequency band provided from the other multi-line phase shifter as a sub input port of the multi-line phase shifter, and a common terminal of the diplexer or duplexer circuit pattern may be connected to a corresponding one of the plurality of radiation elements as an output port of the multi-line phase shifter.

In another aspect of the present invention, a multi-band mobile communication base station antenna includes: a plurality of radiation elements configured to service at least a common band of a first frequency band and a second frequency band; a first multi-line phase shifter configured to receive an input signal of the first frequency band, to divide and output the received signal so as to correspond to the plurality of radiation elements, and to phase-shift the signals divided to each of the plurality of radiation elements; and a second multi-line phase shifter configured to receive an input signal of the second frequency band, to divide and output the received signal so as to correspond to the plurality of radiation elements, and to phase-shift the signals divided to each of the plurality of radiation elements, wherein the first multi-line phase shifter includes a multi-line phase shifting circuit configured to receive the input signal of the first frequency band and to divide and phase-shift the received signal so as to correspond to the plurality of radiation elements; and a plurality of frequency combination/division circuits configured to receive a plurality of signals divided and phase-shifted by the multi-line phase shifting circuit and a plurality of signals of the second frequency band divided and phase-shifted for the plurality of radiation elements and input by the second multi-line phase shifter, to combine the corresponding signals, and to output the combined signals to the plurality of radiation elements.

Advantageous Effects

As described above, the multi-line phase shifter structure of the multi-band mobile communication base station antenna according to the present invention can reduce the number of feeding cables required in the antenna, and enable the antenna to have a more optimized structure.

BEST MODE

Hereinafter, embodiments of the present invention will be described in detail with reference to the accompanying drawings.

Figure 1:
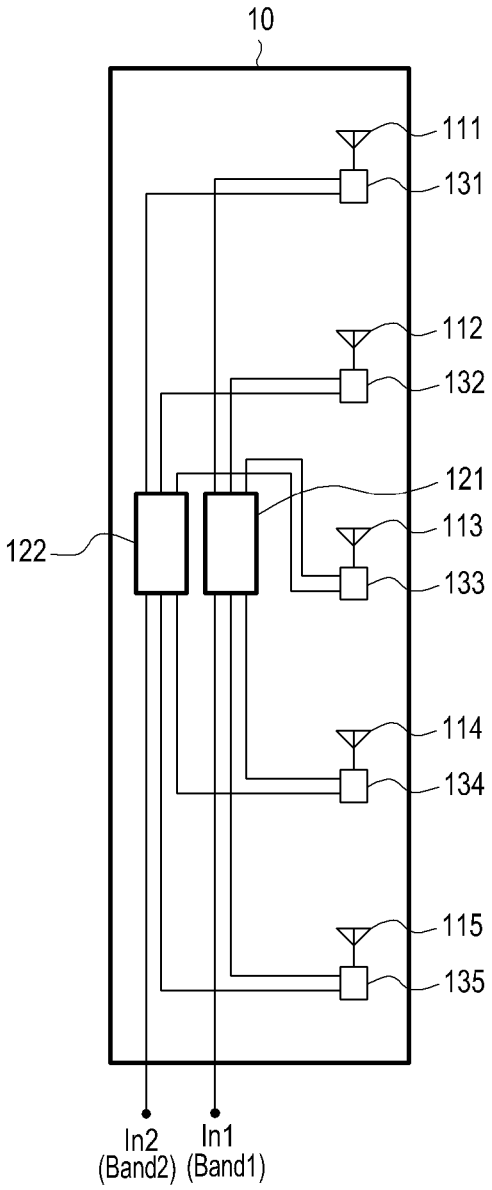
FIG. 1 (PRIOR ART)
FIG. 1 is a schematic block diagram illustrating an example of the configuration of a general multi-band mobile communication base station antenna.
Figure 2:
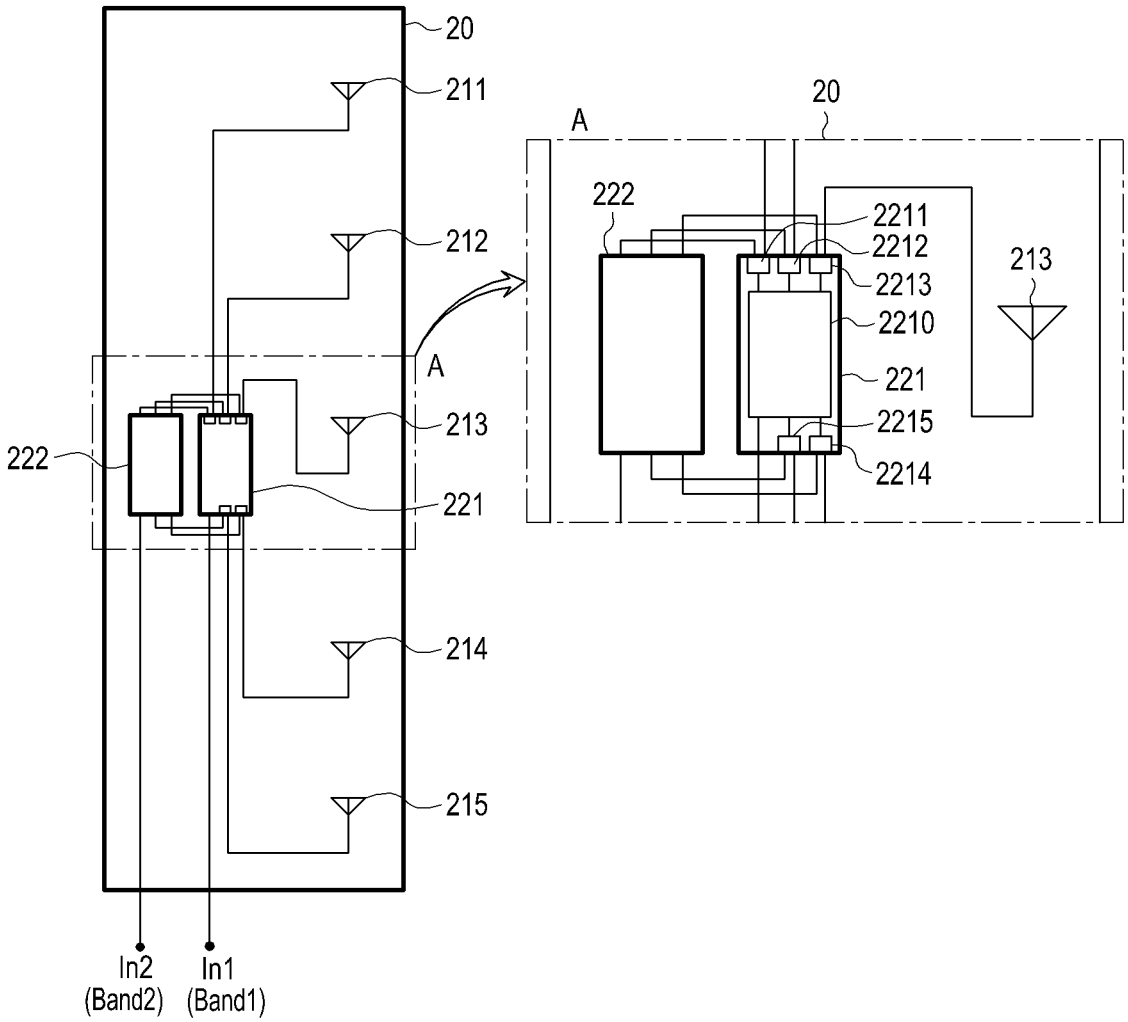
FIG. 2 is a schematic block diagram illustrating the configuration of a multi-band mobile communication base station antenna according to an embodiment of the present invention.

FIG. 2 is a schematic block diagram illustrating the configuration of a multi-band mobile communication base station antenna according to an embodiment of the present invention. Referring to FIG. 2, in the same manner as described in the related art, a multi-band mobile communication base station antenna 20 according to an embodiment of the present invention has a multi-band antenna structure that services a first frequency band Band1 and a second frequency band Band2. Further, a plurality of radiation elements of common first and second frequency bands, for example, first to fifth radiation elements 211, 212, 213, 214, and 215, are configured to be vertically arranged in a line.

Further, in order to provide an electrically vertical tilt with respect to the overall radiated beams of the first frequency band, an input signal In1 of the first frequency band is dividedly output to correspond to the first to fifth radiation elements 211 to 215, and phases of respective divided signals through the radiation elements 211 to 215 are shifted by a first multi-line phase shifter 221 so that the divided signals through the radiation elements 211 to 215 have predetermined phase differences between them. In the same manner, in order to provide an electrically vertical tilt with respect to the overall radiated beams of the second frequency band, an input signal In2 of the second frequency band is dividedly output to correspond to the first to fifth radiation elements 211 to 215, and phases of respective divided signals through the first to fifth radiation elements 211 to 215 are shifted by a second multi-line phase shifter 222 so that the divided signals through the radiation elements 211 to 215 have predetermined phase differences between them.

However, in the multi-band mobile communication base station antenna 20 according to an embodiment of the present invention, the first multi-line phase shifter 221 is connected to the first to fifth radiation elements 211 to 215 through feeding cables, whereas the second multi-line phase shifter 222 is not directly connected to the first to fifth radiation elements 211 to 215, but is configured to provide the signals divided and phase-shifted to correspond to the first to fifth radiation elements 211 to 215 to the first multi-line phase shifter 221.

As illustrated in detail as a tetragonal box A indicated by a dashed dotted line in FIG. 2, the first multi-line phase shifter 221 includes a multi-line phase shifting circuit 2210 configured to receive the input signal In1 of the first frequency band and to divide and phase-shift the received signal so as to correspond to the first to fifth radiation elements 211 to 215; and first to fifth frequency combination/division circuits 2211, 2212, 2213, 2214, and 2215 configured to receive a plurality of signals divided and phase-shifted by the corresponding multi-line phase shifting circuit 2210 and a plurality of signals divided and phase-shifted for the first to fifth radiation elements 211 to 215 and input by the second multi-line phase shifter 222, to combine the corresponding signals, and to output the combined signals toward the first to fifth radiation elements 211 to 215. Each of the first to fifth frequency combination/division circuits 2211 to 2215 may have a diplexer or duplexer circuit structure in which a filter portion configured to filter the first frequency band and a filter portion configured to filter the second frequency band are structurally combined.

According to the above-described structure, it can be known that the second multi-line phase shifter 222 may have a general multi-line phase shifter structure, but the first multi-line phase shifter 221 may have a structure in which a diplexer or a duplexer is included in each output terminal of an internal circuit. Through such a structure, output signals of the second frequency band of the second multi-line phase shifter 222 are combined with signals of the first frequency band to be output from the first multi-line phase shifter 221, and the output signals of the first multi-line phase shifter 221 are finally provided to the radiation elements through the feeding cables.

In this case, the second multi-line phase shifter 222 and the first multi-line phase shifter 221 may be deployed adjacent to each other, and may be connected to each other using relatively short feeding lines (e.g., feeding cables). Accordingly, as compared with the related art, since it is not necessary to provide feeding cables for connecting the signals divided and phase-shifted by the second multi-line phase shifter 222 to the respective radiation elements, the overall necessary feeding cables can be reduced, and the antenna internal structure can be simplified to achieve a stable mechanical structure.

Figure 3:
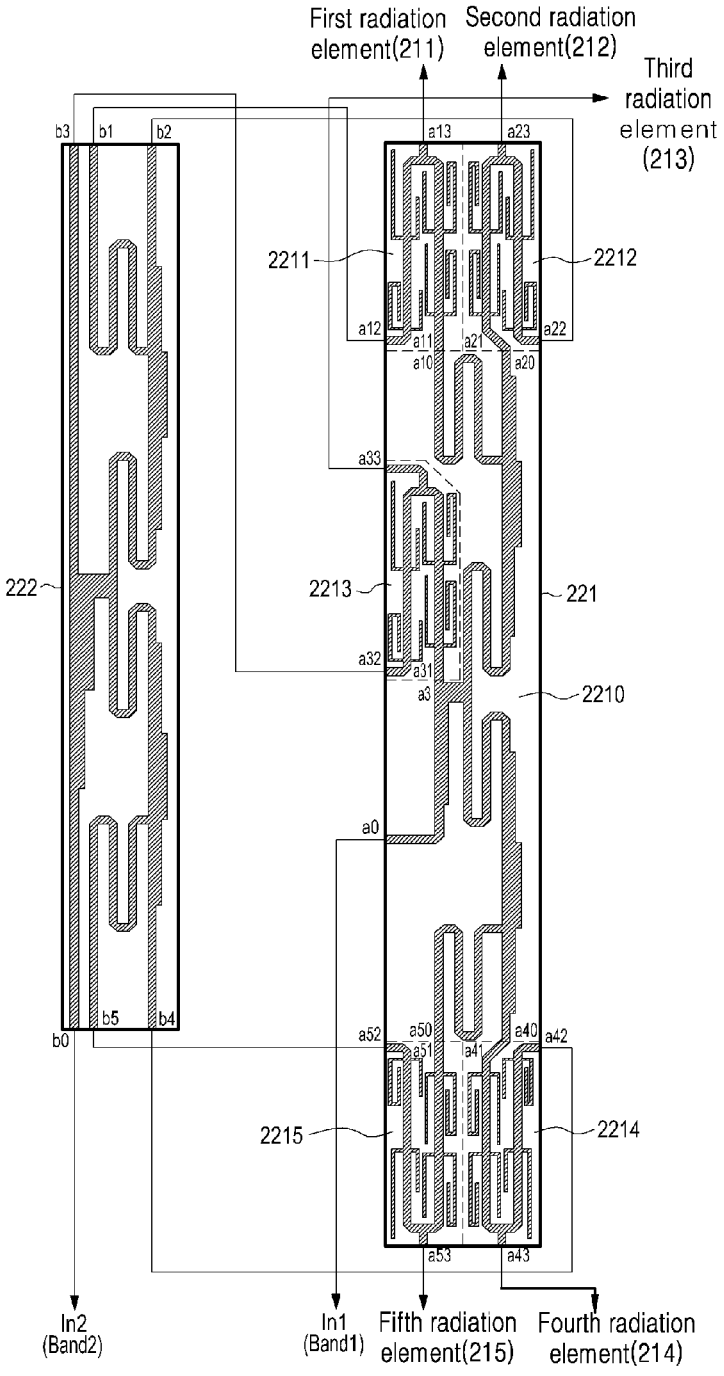
FIG. 3 is a diagram illustrating the detailed configuration of the multi-line phase shifters in FIG. 2.

FIG. 3 is a diagram illustrating the detailed configuration of the multi-line phase shifters in FIG. 2. Referring to FIG. 3, the internal structure of the first and second multi-line phase shifters 221 and 222 will be described in more detail. First, the second multi-line phase shifter 222 may be provided with a PCB type main board on which a circuit pattern for dividing and phase-shifting signals is formed as a primary configuration. On the PCB type main board, an input port b0 for receiving an input signal In2 of the second frequency band and first to fifth output ports b1, b2, b3, b4, and b5 for outputting divided and phase-shifted signals to be provided toward the first to fifth radiation elements 211 to 215 are properly formed. Further, on the main board, a circuit pattern for phase-shifting and dividing the signal input to the input port b0 to the first to fifth output ports b1, b2, b3, b4, and b5 is properly formed. In this case, the division ratio of the input signals divided to the respective ports may not be equally determined, but may be properly predetermined.

In the second multi-line phase shifter 222 having the above-described configuration, the circuit pattern for the phase shifting may be actually formed as a line with a variable length that interlocks with a circuit pattern of a separately provided sub (moving) board (not illustrated) to have a structure capable of performing phase shift. In addition, the second multi-line phase shifter 222 may be provided with a housing for seating thereon and supporting the main board. This configuration is similar to a multi-line phase shifter structure disclosed in Korean Patent Application No. 2009-40978, and thus the multi-line phase shifter structure disclosed in the Korean Patent Application No. 2009-40978 may be adopted as it is.

Next, as for the structure of the first multi-line phase shifter 221, the first multi-line phase shifter 221 may include a PCB type main board as its primary configuration, on which a multi-line phase shifting circuit 2210 having a circuit pattern configured to divide and phase-shift the signal, and a plurality of, that is, first to fifth frequency combination/division circuits 2211, 2212, 2213, 2214, and 2215 having circuit patterns for frequency combination/division connected to the circuit pattern of the multi-line phase shifting circuit 2210 are formed.

On the PCB type main board, the circuit pattern that forms the multi-line phase shifting circuit 2210 is formed in a manner that an input port a0 for receiving an input signal In1 of the first frequency band and first to fifth output points a10, a20, a30, a40, and a50 for outputting the divided and phase-shifted signals to be provided toward the first to fifth radiation elements 211 to 215 are formed, and a circuit pattern for dividing and phase-shifting the signal input to the input port a0 toward the first to fifth output points a10, a20, a30, a40, and a50 is properly formed.

Further, on the main board, the first to fifth output points a10, a20, a30, a40, and a50 of the multi-line phase shifting circuit 2210 are respectively connected to first to fifth input points a11, a21, a31, a41, and a51 corresponding to the first to fifth frequency combination/division circuits 2211, 2212, 2213, 2214, and 2215. The first to fifth frequency combination/division circuits 2211 to 2215 may be implemented, for example, by a PCB type diplexer (or duplexer) circuit pattern, and in this case, first input terminals of the corresponding diplexer (or duplexer) circuit patterns for the first to fifth frequency combination/division circuits 2211 to 2215 correspond to the first to fifth input points a11, a21, a31, a41, and a51.

Further, the first to fifth frequency combination/division circuits 2211 to 2215 are configured to receive the signals output from the first to fifth output ports b1 to b5 of the second multi-line phase shifter 222 through the second input terminals of the corresponding diplexer circuit patterns. For example, the signal output from the first output port b1 of the second multi-line phase shifter 222 is input to the first sub input port a12 of the first multi-line phase shifter 221 to be provided to the first frequency combination/division circuit 2111, and in the same manner, the signals output from the second to fifth output ports b2 to b5 of the second multi-line phase shifter 222 are input to the second to fifth sub input ports a22, a32, a42, and a52 of the first multi-line phase shifter 221 to be provided to the second to fifth frequency combination/division circuits 2212 to 2215. That is, the second input terminals of the corresponding diplexer circuit patterns of the first to fifth frequency combination/division circuits 2211 to 2215 correspond to the first to fifth sub input ports a12, a22, a32, a42, and a52.

Further, the first to fifth frequency combination/division circuits 2211 to 2215 are configured so that the signals output from common terminals of the corresponding diplexer circuit patterns are provided to the corresponding first to fifth radiation elements 211 to 215. For example, the common terminal of the first frequency combination/division circuit 2211 corresponds to the first output port a13 of the corresponding first multi-line phase shifter 221, and is connected to the first radiation element 211. In the same manner, the common terminals of the second to fifth frequency combination/division circuits 2212 to 2215 correspond to the second to fifth output ports a23, a33, a43, and a53 of the corresponding first multi-line phase shifter 221, and are connected to the second to fifth radiation elements 212 to 215, respectively.

In the multi-line phase shifting circuit 2210 of the first multi-line phase shifter 221 having the above-described configuration, the circuit pattern for the phase shifting may be actually formed as a line with a variable length that interlocks with a circuit pattern of a separately provided sub (moving) board (not illustrated) to have a structure capable of performing the phase shift. In addition, the first multi-line phase shifter 221 may be provided with a housing for seating thereon and supporting the main board.

As illustrated in FIG. 3, in the first multi-line phase shifter 221, the multi-line phase shifting circuit 2210 and the first to fifth frequency combination/division circuits 2211, 2212, 2213, 2214, and 2215 are integrally formed on one PCB type main board. Accordingly, in the case of being applied to the multi-band mobile communication base station antenna, as compared with the related art, the installation region of the feeding cables can be reduced as a whole, and the antenna internal structure can be simplified.

The multi-line phase shifter of the multi-band mobile communication base station antenna according to the embodiments of the present invention may be configured and operated as described above. Although the detailed embodiments of the present invention have been described, various modifications may be made without departing from the scope of the present invention.

For example, in the multi-band mobile communication base station antenna as described above, configurations that are not related to the present invention have been simplified or omitted. In the multi-band mobile communication base station antenna according to an embodiment of the present invention, the first to fifth radiation elements 211 to 215, in the same manner as the general structure, may be installed on one surface (e.g., front surface) of a metal plate shaped reflective plate (not illustrated) having a relative large area as a whole, and the first and second multi-line phase shifters 221 and 222 may be installed on the other surface (e.g., rear surface) of the reflective plate. Further, in the corresponding mobile communication base station antenna, various components applied to the mobile communication base station antenna having a general structure, for example, an additional division/combination circuit, an amplifier, and a filter, may be provided, and further, various electronic components (not illustrated), such as a sensing circuit for sensing various operating states of the antenna including a signal transmission quality and a main control device (e.g., MCU) for controlling the overall operation, may be appropriately provided.

From the foregoing, although it is exemplified that 5 radiation elements are provided in the multi-mode mobile communication base station antenna, various numbers of radiation elements may be deployed, and thus various numbers of frequency division/combination circuits may be designed to be formed in the second multi-line phase shifter.

In addition to the above-described embodiments, various modifications and changes may be made with respect to the detailed structure of the circuit patterns on the main board of the multi-line phase shifting circuit or the frequency division/combination circuits in the first or second multi-line phase shifter, and thus the scope of the present invention should not be determined by the above-described embodiments, but should be determined by the appended claims and equivalents thereof.

What is claimed is:

1. A multi-line phase shifter, comprising:

a multi-line phase shifting circuit configured to receive an input signal of a first frequency band and to divide and phase-shift the received signal so as to correspond to a plurality of radiation elements; and a plurality of frequency combination/division circuits configured to receive a plurality of signals divided and phase-shifted by the multi-line phase shifting circuit and a plurality of signals of a second frequency band divided and phase-shifted for the plurality of radiation elements and input by an external multi-line phase shifter, to combine the corresponding signals, and to output the combined signals to the plurality of radiation elements, wherein the multi-line phase shifting circuit comprises a circuit pattern formed on a PCB type main board to phase-shift and divide the input signal inputted to an input port to a plurality of output points.

2. The multi-line phase shifter of claim 1, wherein each of the plurality of frequency combination/division circuits has a diplexer or duplexer circuit structure in which a first filter portion configured to filter the first frequency band and a second filter portion configured to filter the second frequency band are structurally combined.

3. The multi-line phase shifter of claim 1, wherein each of the plurality of frequency combination/division circuits is implemented by a PCB type diplexer or duplexer circuit pattern on the main board, and in each of the plurality of frequency combination/division circuits, a first input terminal of the diplexer or duplexer circuit pattern is connected to a corresponding one of the plurality of output points of the multi-line phase shifting circuit, a second input terminal of the diplexer or duplexer circuit pattern receives a corresponding one of the plurality of signals of the second frequency band provided from the external multi-line phase shifter as a sub input port of the multi-line phase shifter, and a common terminal of the diplexer or duplexer circuit pattern is connected to a corresponding one of the plurality of radiation elements as an output port of the multi-line phase shifter.

4. A multi-band mobile communication base station antenna comprising:

a plurality of radiation elements configured to service at least a common band of a first frequency band and a second frequency band;

a first multi-line phase shifter configured to receive an input signal of the first frequency band, to divide and output the received signal so as to correspond to the plurality of radiation elements, and to phase-shift the signals divided to each of the plurality of radiation elements; and a second multi-line phase shifter configured to receive an input signal of the second frequency band, to divide and output the received signal so as to correspond to the plurality of radiation elements, and to phase-shift the signals divided to each of the plurality of radiation elements, wherein the first multi-line phase shifter includes:

a multi-line phase shifting circuit configured to receive the input signal of the first frequency band and to divide and phase-shift the received signal so as to correspond to the plurality of radiation elements; and a plurality of frequency combination/division circuits configured to receive a plurality of signals divided and phase-shifted by the multi-line phase shifting circuit and a plurality of signals of the second frequency band divided and phase-shifted for the plurality of radiation elements and input by the second multi-line phase shifter, to combine the corresponding signals, and to output the combined signals to the plurality of radiation elements.

5. The base station antenna of claim 4, wherein each of the plurality of frequency combination/division circuits has a diplexer or duplexer circuit structure in which a filter portion configured to filter the first frequency band and a filter portion configured to filter the second frequency band are structurally combined.

6. The base station antenna of claim 4, wherein the multi-line phase shifting circuit comprises a circuit pattern formed on a PCB type main board to phase-shift and divide a signal input to an input port that receives the input signal of the first frequency band to a plurality of output points, each of the plurality of frequency combination/division circuits is implemented by a PCB type diplexer or duplexer circuit pattern on the main board, and in each of the plurality of frequency combination/division circuits, a first input terminal of the diplexer or duplexer circuit pattern is connected to a corresponding one of the plurality of output points of the multi-line phase shifting circuit, a second input terminal of the diplexer or duplexer circuit pattern receives a corresponding one of the plurality of signals of the second frequency band provided from the other multi-line phase shifter as a sub input port of the multi-line phase shifter, and a common terminal of the diplexer or duplexer circuit pattern is connected to a corresponding one of the plurality of radiation elements as an output port of the multi-line phase shifter.

7. An antenna, comprising a first multi-line phase shifter, wherein the first multi-line phase shifter comprises:

a multi-line phase shifting circuit configured to receive an input signal of a first frequency band and to divide and phase-shift the received signal provide to a first number of first signals to; and a first number of frequency combination/division circuits configured to receive the first number of first signals divided and phase-shifted by the multi-line phase shifting circuit and a first number of second signals of a second frequency band, wherein each of the first number of frequency combination/division circuits is configured to combine one of the first number of first signals and one of the first number of second signals to generate a combined signal such that a first number of combined signals are output by the first number of frequency combination/division circuits.

8. The antenna of claim 7, further comprising:

a second multi-line phase shifter configured to divide and phase-shift another signal of the second frequency band to generate the first number of second signals.

9. The antenna of claim 7, wherein each of the first number of the frequency combination/division circuits has a diplexer or duplexer circuit comprising a first filter and a second filter, wherein the first filter is configured to filter the first frequency band and the second filter is configured to filter the second frequency band.

10. The antenna of claim 9, wherein the multi-line phase shifting circuit comprises a circuit pattern formed on a PCB board, wherein the circuit pattern is configured to phase-shift and divide a signal input to an input port that receives the input signal of the first frequency band to the first number of output points.

11. The antenna of claim 10, wherein, in each of the first number of the frequency combination/division circuits, a first input terminal of the diplexer or duplexer circuit pattern is connected to a corresponding one of the first number of output points of the multi-line phase shifting circuit, and a second input terminal of the diplexer or duplexer circuit pattern receives a corresponding one of the first number of signals of the second frequency band provided from a second multi-line phase shifter.

12. The antenna of claim 11, wherein a common terminal of the diplexer or duplexer circuit pattern is connected to a corresponding one of the first number of radiation elements.

* * * * *